United States Patent [19]

Garner

[11] Patent Number: 4,527,537

[45] Date of Patent: Jul. 9, 1985

[54] DRESSING TOOL FOR GRINDING WHEELS

[76] Inventor: Edward D. Garner, 4200 N. 48th St., Lincoln, Nebr. 68504

[21] Appl. No.: 575,075

[22] Filed: Jan. 30, 1984

[51] Int. Cl.[3] ..... B24B 53/08

[52] U.S. Cl. ..... 125/11 TP; 125/11 F; 125/39; 408/714; 408/156; 408/181

[58] Field of Search ..... 125/11 F, 11 TP, 11 N, 125/39; 408/714, 713, 154, 156, 181

[56] References Cited

U.S. PATENT DOCUMENTS

| | | | |
|---|---|---|---|
| 362,360 | 5/1887 | Convers | 125/39 |
| 2,266,339 | 12/1941 | Shutz | 408/156 |
| 2,584,003 | 1/1952 | Engelmann | 125/11 F |
| 2,654,610 | 10/1953 | De Vlieg | 408/181 |
| 2,884,025 | 4/1959 | Fales | 125/11 TP |
| 2,912,971 | 11/1959 | Miller | 125/39 |
| 3,148,561 | 9/1964 | Krampert | 408/181 |
| 3,433,104 | 3/1969 | Milewski | 408/156 |
| 3,765,788 | 10/1973 | Gulibon | 408/181 |
| 4,291,666 | 9/1981 | Garner | 125/11 F |

FOREIGN PATENT DOCUMENTS

| | | | |
|---|---|---|---|
| 553151 | 5/1943 | United Kingdom | 125/39 |
| 733211 | 7/1955 | United Kingdom | 125/11 F |

*Primary Examiner*—Harold D. Whitehead
*Attorney, Agent, or Firm*—Morton S. Adler

[57] ABSTRACT

A diamond point type dressing tool with means for adjustment to dead center within a tolerance of ±0.0001" is mounted to a control head assembly capable of producing horizontal, rotary and vertical movements of the tool either independently or simultaneously to reproduce from a remotely disposed associated template any desired contour of angles and radii on the peripheral edge of a grinding wheel. A tracing rod, snugly but slidably journalled through a support ball, has a tracing end adapted for manual movement over the profile of the template and a control end operatively associated with the control head for reproducing the template profile in the movement of the dressing tool and for rotating the diamond point where necessary on the profile. The ball support is seated in the control head and is fixed against lateral or vertical movement but has the capablility of turning in place as the orientation of the axis of the rod is changed during movement over the profile. In either the horizontal or vertical movement of the control end of the rod, slidable movement of the rod through the ball support serves to keep constant the distance between parallel lines through the axis of the ball support and the control end of the rod. The ratio of movement of the rod control end and the tracing rod end due to the ball support together with a corresponding ratio of the template profile relative to the dimensions of the edge of the wheel may be designed for 1:1 or greater and different selected corresponding ratios such as 5:1 or 10:1 for extreme accuracy may be provided in the design of the tool.

19 Claims, 5 Drawing Figures

DRESSING TOOL FOR GRINDING WHEELS

BACKGROUND OF THE INVENTION

This invention relates to a dressing tool for transferring a template profile to a grinding wheel edge and is an improvement of the dressing tool disclosed in my U.S. Pat. No. 4,291,666.

The use of dressing tools to form a desired contour or profile on the grinding wheel corresponding to an associated template is an old expedient and many and varied devices have been designed for such purposes. In such tools as presently used except for the device in my U.S. Pat. No. 4,291,666, it appears to be a common and consistent practice to form the template profile with the exact dimensions relative to those of the grinding wheel edge on a 1:1 ratio so that the tracing means for transferring the profile is limited to the same ratio. This requires that the template be highly accurate and that the tracing apparatus be equally accurate. It is thus apparent that should any variations or imperfections in the tolerances exist either in the template profile or in the tracing apparatus, they are transferred in their full magnitude so that considerable time, labor and expense can be incurred to avoid any such results.

The dressing tool in my U.S. Pat. No. 4,291,666 is designed for using an associated template where the ratio of the template profile dimensions to the dimensions on the grinding wheel and the corresponding ratio of operating efficiency of the tracing apparatus may be 1:1 and preferably greater on the order of 10:1 and with ratios greater than 1:1 has substantially improved the accuracy of reproduction of the profile onto the grinding wheel over other devices for such purposes. In this regard, the greater the ratio, the more accurate is the reproduction of the profile on the grinding wheel and for all practical purposes ratios greater than 10:1 are not deemed necessary to assure satisfactory accuracy. The present invention also uses a ratio greater than 1:1 and preferably 5:1 or 10:1 and has been improved in several respects to further increase its accuracy and operating efficiency.

Accordingly, it is one of the important objects of this invention to provide a dressing tool of the above class with an improved diamond point mount assembly capable of adjusting the diamond point to dead center within a tolerance of ±0.0001".

A further object herein is to provide a dressing tool as characterized that includes an improved tracing rod having a notched portion at its point of contact with the template so that such point of contact is planar with the longitudinal axis of the rod and thus materially increases the accuracy of this tool.

Still another object of this invention is to provide a dressing tool for grinding wheels that includes an improved control head assembly comprising a fixed base plate and a movable plate carrying the diamond point mount assembly and with the movable plate yieldingly held in juxtaposition to said base plate by a tracing rod which extends through the base plate in spring loaded relationship to operatively engage the movable plate whereby vertical, horizontal or rotary movement of the tracing rod produces corresponding movement in said movable plate and the diamond point.

The foregoing objects and such further objects as may appear herein, or be hereinafter pointed out, together with the advantages of this invention will be more fully discussed and developed in the more detailed description of the accompanying drawings.

DESCRIPTION OF THE PREFERRED EMBODIMENTS

Figure 1:
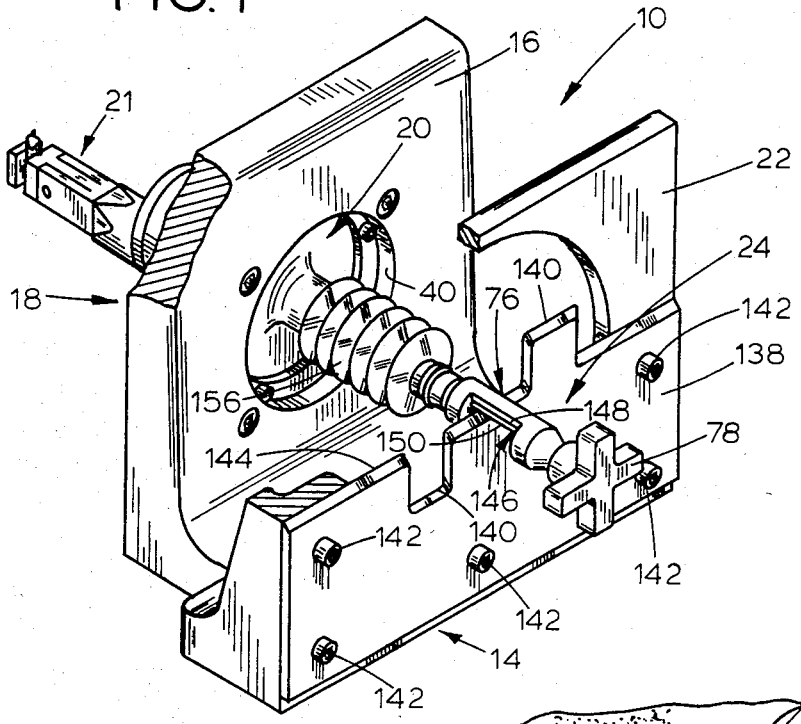
FIG. 1 is a perspective rear view of this dressing tool with portions broken away for purposes of illustration.

Referring to the drawings, this new dressing tool is designated generally by the numeral 10 and includes a base 12 having a rear end 14 and an integral upstanding wall 16 defining a front end 18. A control head assembly 20 with a diamond point mount assembly 21 is carried by end 18 and a template support means such as frame 22 is arranged on end 14 with a tracing rod assembly 24 operatively associated with assembly 20 and support 22, all of which will be referred to in more detail as this description proceeds.

Base 12 is flat to rest on any suitable flat surface (not shown) and is provided with a transverse hole 26 for attachment to such support by a suitable fastening means. The control head assembly 20 is secured to wall 16 of base 12 and is constructed and arranged as follows with reference being made more particularly to FIGS. 2 and 3.

Figure 2:
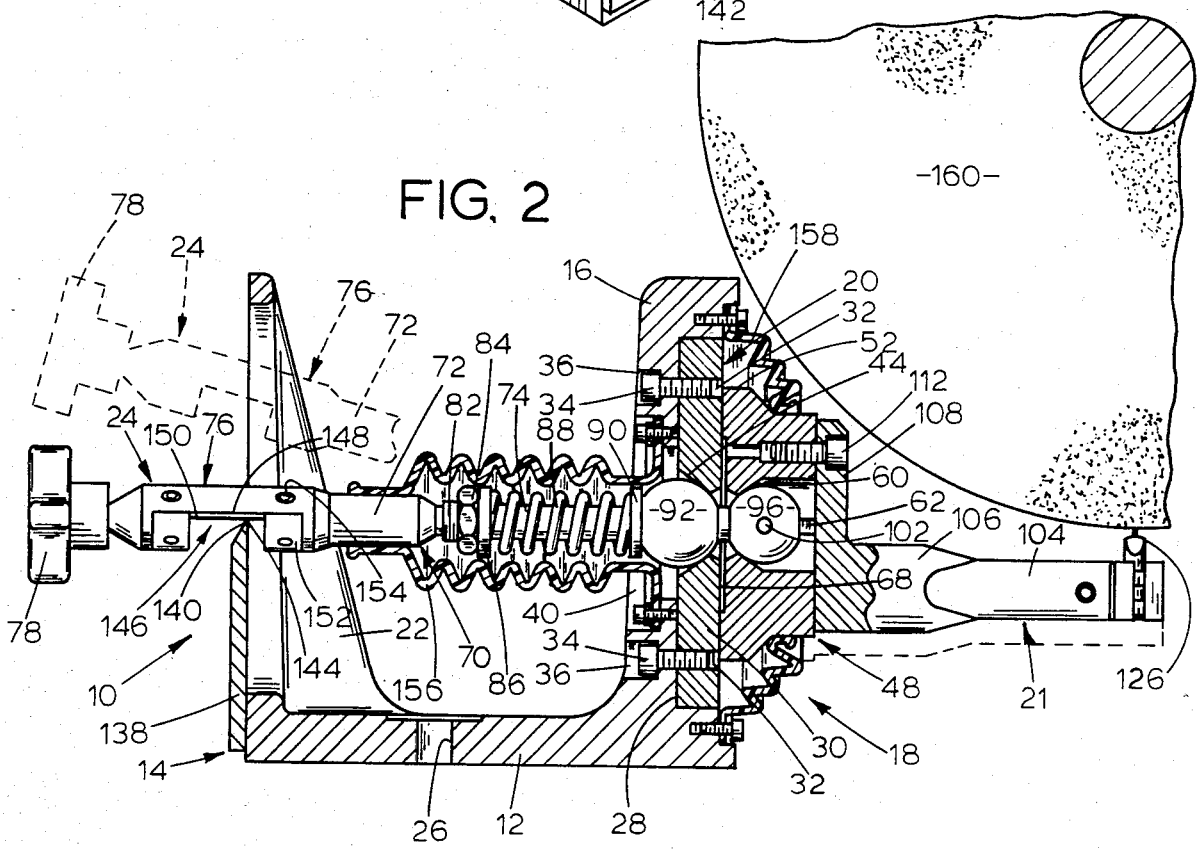
FIG. 2 is a side view of this tool partly in section and showing its relationship to a grinding wheel.

The front side 28 of wall 16 may be recessed as shown in FIG. 2 or may be planar to receive the base plate 30 which is provided with suitably spaced threaded holes 32 and is fixedly secured to wall 16 by the threaded bolts 34 applied from the rear side of said wall through the respective holes 36 therein to but not beyond the front face of said wall. Plate 30 is provided with an axial bore 38 in registration with the concentrically larger opening 40 through wall 16 and is bevelled 42 from its rear side adjacent wall 16 to define a ball socket 44. The bore 38 at the front side 39 of plate 30 is provided with a short bevel 46 for clearance.

Figures 3, 4, 5:
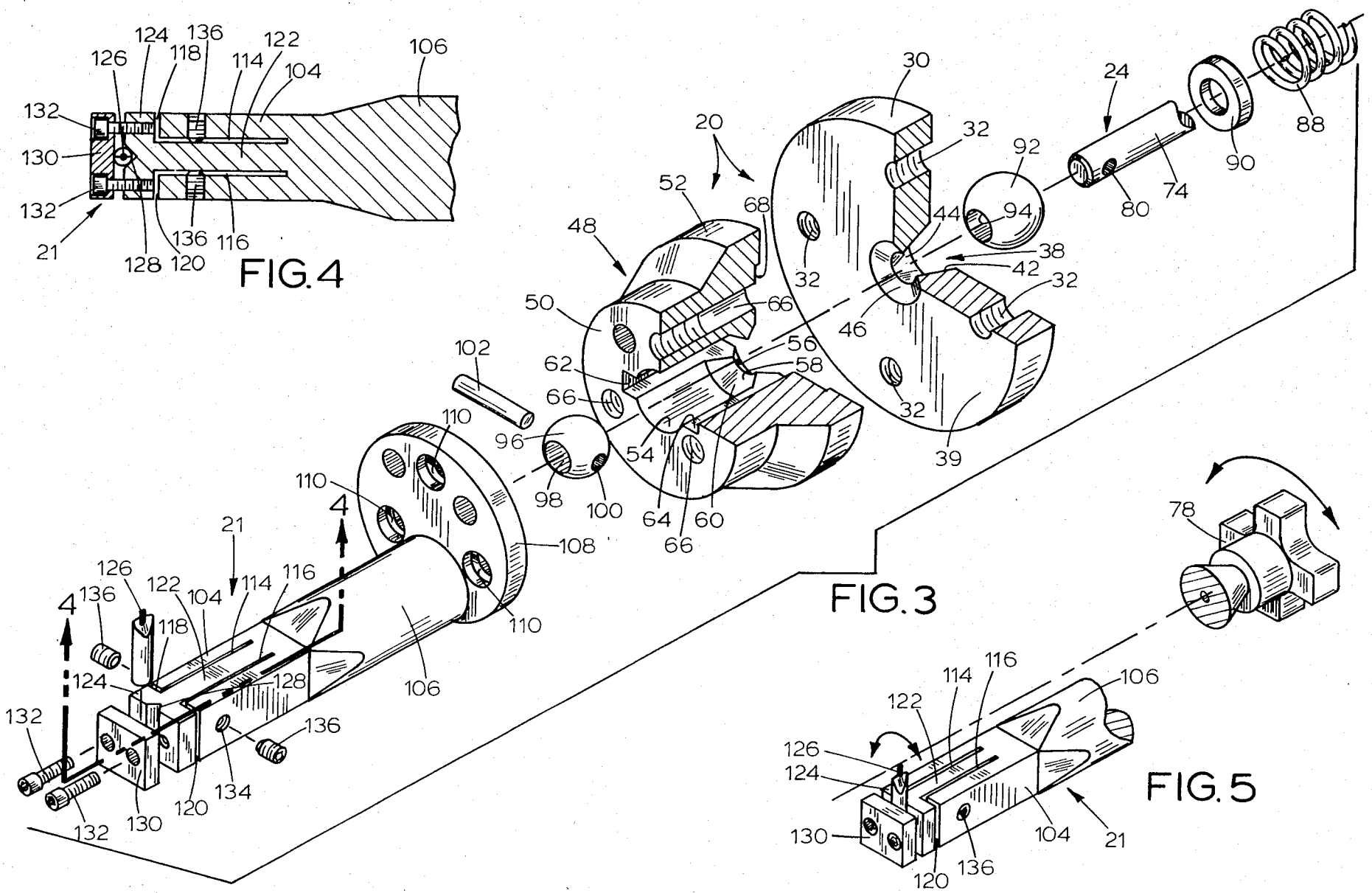
FIG. 3 is an exploded perspective view of the diamond point mount assembly, the control head assembly and a portion of the tracing rod assembly used with this invention.
FIG. 4 is a cross sectional view taken on the line 4—4 of FIG. 3 to show the diamond point mount construction permitting adjustment of the diamond point to dead center.
FIG. 5 is a perspective exploded view showing the rotary movement control relationship of the diamond point mount by the control knob on the tracing rod.

A movable plate 48, as best seen in FIG. 3, includes a forward portion defining an annular body 50 and a rear portion defining an integral concentrically enlarged flange 52. Plate 48 is provided with an axial bore 54 to register with bore 38 in plate 30, and bore 54 is provided on the face of flange 52 with the short outward bevel 56 for clearance to register with the complementary bevel 46 in plate 30. An inward bevel 58 adjacent bevel 56 is oriented toward the face of body 50 to provide a ball socket 60. Bore 54 communicates with the diametrically opposed key slots 62, 64 as seen in FIG. 3, and concentrically arranged in plate 48 about bore 54 are a plurality of spaced threaded bolt holes 66. The face of flange 52 is provided with a shallow annular recess 68 of greater diameter than bore 54. Plate 48 is an improvement over other dressing tools, including my U.S. Pat. No. 4,291,666, in controlling the operation and functioning of such tools and is designed so that flange 52 is yieldingly held in juxtaposition with the front side 39 of plate 30 whereby plate 48 and the attached diamond point assembly 21 can move horizontally, vertically, diagonally or rotary or any selected combination of the same in response to movement by the tracing rod assembly 24 which will now be described with reference more particularly to FIGS. 2 and 3.

Assembly 24 includes a tracing rod member 70 having a central cylindrical portion 72 integral with and intermediate an elongated forward rod portion 74 concentrically smaller than portion 72 and a rearwardly disposed stylus mount means 76 which will be later referred to in more detail. A knob handle 78 is removably mounted to the rear end of mount 76 and a transverse hole 80 is provided near the forward end of rod portion 74.

Rod portion 74 at its extension from the central portion 72 is externally threaded 82 (FIG. 2) to receive the nut 84 which bears against one side of washer 86. A coil spring 88 on portion 74 is disposed intermediate the other side of washer 86 and one side of the longitudinally spaced washer 90. A first ball or sphere 92 provided with a bore 94 is snugly journalled on rod portion 74 to abut the other side of washer 90. The fit of ball 92 on portion 74 is such as to permit a sliding movement of portion 74 as will later appear.

Thus far described, rod portion 74 is inserted through the bore 40 in wall 16 from the rear thereof and through the bore 38 in plate 30 as that ball 92 is seated in socket 44 in plate 30 as seen in FIG. 2. With plate 48 juxtaposed to plate 30 so that bore 54 therein is aligned with bore 38 in plate 30, a second ball or sphere 96 is seated in socket 60 of plate 48 and is provided with a bore 98 through which the free end of rod portion 74 is journalled so that hole 80 is disposed within the interior of said ball. Ball 96 is provided with a transverse hole 100 intersecting bore 98 and in registration with hole 80 to receive the key pin 102 that extends through rod portion 74 and projects outwardly from each side of ball 96 into the respective slots 62, 64. The tightening of nut 84 will act to hold plate 48 yieldingly against plate 30 and permit plate 48 to be moved in any direction in response to movement of rod portion 74 as will be more fully described in the operation of this device. The selected movements of plate 48 control the manipulation of the diamond point mount assembly 21 which is constructed and arranged as follows.

Assembly 21 is a generally elongated cast member comprising a forward diamond point mount and adjustment portion 104 that is preferably rectangular and a rear cylindrical portion 106 to the rear end of which is integrally formed the annual mounting plate 108 as best seen in FIG. 2. Plate 108 is provided with a plurality of concentrically arranged and spaced holes 110 to register respectively with holes 66 in plate 48 whereby assembly 21 is secured to the control head assembly 20 by attaching plate 108 to plate 48 with suitable bolts 112 as seen in FIG. 2, it being noted that bolts 112 do not extend into plate 30.

Portion 104 (FIGS. 2,4) has two parallel spaced longitudinal slices 114, 116 extending therethrough from top to bottom which extend from portion 106 to the front of portion 104 at a point inwardly spaced from the front end where lateral opposed slices 118, 120 communicate respectively with slices 114, 116. By this arrangement, there is formed a T-shaped member defined by the shank 122 intermediate slices 114, 116 which is narrower than the portions of 104 outside the slices and the head portion 124 designed to hold the diamond point 126 in notch 128 and secured by the clamp 130 with bolts 132 as shown. Opposed sides of portion 104 are provided with a respective threaded hole 134 just rearwardly of lateral slices 118, 120 to receive a set screw 136 for engaging shank 122 as seen in FIG. 4. Thus, by tightening or loosening selected screws 136, the diamond point 126 can be easily adjusted to dead center with an accuracy of ±0.0002" and with care to an accuracy of ±0.0001".

The template support 22 is an upstanding open frame member integral with base 12 at the rear 14 thereof to which a template 138 of any selected contour surface 140 is removably secured by means of bolts 142 as seen in FIG. 1. Surface 140 is preferred bevelled or inclined to define a high front edge 144 which is movably engaged by portion 76 of the tracing rod assembly 24 as fllows.

Portion 76 is notched 146 to provide an inset longitudinal surface 148 that is planar with the longitudinal axis of rod portions 72, 74 and adjacent to which a tracing stylus rod 150 is mounted and secured by the removable stylus retainers 152 held in place by screws 154. A suitable accordion shaped dust cover 156 embraces rod portion 74 and a similar cover 158 is provided at the front of the control head assembly 20 as seen in FIG. 2. With tool 10 constructed as described, its use in dressing a wheel 160 is as follows.

OPERATION

While the dressing tool 10 described herein for transferring a template profile 140 to a grinding wheel 160 may utilize any desirable ratio between the template profile and the wheel such as 1:1 or greater, I recommend a 5:1 or 10:1 ratio which has proved adequate to assure satisfactory accuracy since at such ratio, any existing variations or imperfections in the exacting requirements of the desired tolerances that would normally require reworking for elimination are reduced in transfer to a grinding wheel by the ratio relationship to a point where, for all practical purposes, they become insignificant and it will be understood in this invention that the template profile 140 used will be enlarged relative to the profile on wheel 160 by the ratio selected and will be rotated one hundred eighty degrees.

Before operating this tool, the diamond point 126 can be adjusted to dead center by tightening and/or loosening the set screws 136 as required (FIGS. 3,4) since the slices 114, 116, 118, and 120 in mount 104 provide shank 122 with sufficient flexibility for such purpose. Accuracy to ±0.0002" is easily produced and accuracy of ±0.0001" is possible if desired which is a substantial improvement over the adjustment capabilities of like devices.

As seen in FIGS. 1,2, the stylus 150 is designed to rest on the forward edge 144 of template surface 140 and in this position the diamond point 126 will be in contact with wheel 158 but will always leave the wheel if the stylus leaves the template for any reason so that no improper cut occurs if the stylus loses contact with the template.

The notched configuration 146 of the stylus mount 76 is another improved feature of this device as it places stylus 150 planar with the longitudinal axis of rods 72, 74 and thus increases the accuracy of reproduction on the wheel over other similar tools where the periphery of the stylus generally contacts the template and is thus offset from true planar alignment with the axis of the stylus.

In operation, the tracing rod assembly 24, held by knob 78 with stylus 150 on the profile edge 144, is moved across the profile in whatever direction is indicated on the profile to effect reverse complementary movement of the diamond point 126. As such movements of rod portion 74 occur, ball 92 will turn in place to accommodate the changing orientation of the axis of rod portion 74. The forward end of rod portion 74 being anchored to ball 96 by pin 102 will cause ball 96 to act against plate 48 to slide or move it in juxtaposition relative to plate 30 accordingly in any direction and correspondingly move the diamond point 126. In such movement of plate 48, the distance between vertical lines and between horizontal lines through the axes of balls 92 and 96 remains constant although the linear distance between the axes of balls 92 and 96 will vary depending upon whether stylus 150 is at the center point of the template or at the right or left thereof, such distance being greater away from center and to accommodate such variations, rod portion 74 will slide relative to ball 92 so that, in effect, the line of movement of the knob 78 away from the center of the template will be in an arc. At all times, the distance between the axes of balls 92 and 96 and the distance between the axis of ball 92 and the point where stylus 150 touches the template is always proportional.

The stylus 150 can be rotated by turning knob 78 as it changes direction according to the profile outline to keep it in appropriate contact therewith and because rod portion 74 is secured to ball 96 that in turn is keyed to plate 48 by pin 102 in slots 62, the rotation of the stylus effects the rotation of plate 48 to produce a corresponding movement of the diamond point 126, as illustrated in FIG. 5, to keep such point perpendicular to the wheel. In other devices of this type while the diamond mount may be separately manually rotatable, the present invention now makes this possible from the knob 78.

Since plates 30 and 48 are always in juxtaposition, the recess 68 in plate 48 minimizes any ringing in or cohesion as plate 48 is moved and this may also be avoided by using plate material of any suitable type that has a low propensity for cohesion in such contact and movement.

Accordingly, in view of the foregoing, it is thought a full understanding of the construction and operation of this invention will be had and the advantages of the same will be appreciated.

I claim:

1. A dressing tool for grinding wheels, comprising:

a vertically disposed fixed plate having a front and rear side, a template with a predetermined profile mounted in a predetermined spaced relationship from the rear side of said fixed plate, a second plate disposed in juxtaposition with the front side of said fixed plate, an elongated tracing rod having a first end and a second end, means extending said first end through said fixed plate from the rear side free of engagement therewith and into said second plate, means for operatively securing said first end to said second plate, yielding means on said rod intermediate said fixed plate and said template and operatively engaging the rear side of said first plate, means for adjusting said yielding means whereby said second plate is yieldingly held in juxtaposition with said fixed plate and capable of horizontal, lateral, rotary and diagonal movement relative thereto separately or in combination in response to movement of said rod, a diamond point mount means operatively secured to said second plate and correspondingly movable therewith, and said second end of said rod disposed and adapted for manual movement in contact with said profile whereby said first end acts against said second plate to move the same and correspondingly move said diamond point to reproduce the template profile.

2. A dressing tool as defined in claim 1 wherein said diamond point mount means comprises:

an elongated body having a front portion which includes a diamond point support member and a rear portion, means on said rear portion for removable attachment to said second plate, said front portion provided with spaced slices therethrough embracing said diamond point support member to define an intermediate body section free of engagement with said body but capable of movement within the confines of said slices, means for mounting a diamond point on said diamond point support member, and opposed means on said front portion for respectively engaging said intermediate body section from opposite sides to selectively move it within the confines of said slices for adjusting said diamond point to dead center.

3. A dressing tool as defined in claim 2 wherein said opposed means on said front portion comprises respective set screws in said body for respectively engaging said intermediate body section.

4. A dressing tool as defined in claim 1 wherein said diamond point mount means comprises:

an elongated body having a front end which includes a diamond point support portion and a rear end, means on said rear end for removable attachment to said second plate, said body provided with spaced slices therethrough embracing said diamond point support portion and extending to a predetermined point towards said rear end to define a shank member integral with said diamond support portion whereby said diamond point support portion and shank member are free of engagement with said body but capable of movement within the confines of said slices, means for mounting a diamond point on said diamond point support portion, and opposed means near said front end for respectively engaging said shank member from opposite sides to selectively move it within the confines of said slices for adjusting said diamond point to dead center.

5. A dressing tool as defined in claim 1 wherein said diamond point mount means comprises:

an elongated body having a front end which includes a diamond support portion and a rear end, means on said rear end for removable attachment to said second plate, said body provided with spaced parallel first slices therethrough extending from a predetermined point spaced from said rear end to a predetermined point spaced from said front end to define a shank member and with opposed second slices therethrough perpendicular to said first slices and respectively communicating with said first slices near said fron end to define said diamond point support portion integral with said shank member that is free of engagement with said body but capable of movement within the confines of said slices, means for mounting a diamond point on said diamond point support portion, and respective opposed set screws in said body near said front end for respectively engaging said shank member from opposite sides to selectively move it for adjusting said diamond point to dead center.

6. A dressing tool as defined in claim 1 wherein the portion of said second end of said tracing rod adapted for manual movement in contact with the template profile is constructed and arranged so that the surface thereof in contact with the profile is planar with the longitudinal axis of said tracing rod.

7. A dressing tool as defined in claim 1 wherein the second end of said tracing rod adapted for manual movement in concontact with the template profile is notched so that the notched surface thereof is in contact with the template profile and is planar with the longitudinal axis of said tracing rod.

8. A diamond point mount for a dressing tool of the type designed for reproducing a template profile on a grinding wheek, comprising:

an elongated body having a front portion which includes a diamond point support member and a rear portion, means on said rear portion for removable attachment to a dressing tool, said front portion provided with spaced slices therethrough embracing said diamond point support member to define an intermediate body section free of engagement with said body but capable of movement within the confines of said slices, means for mounting a diamond point on said diamond point support member, and opposed means on said front portion for respectively engaging said intermediate body section from opposite sides to selectively move it within the confines of said slices for adjusting said diamond point to dead center.

9. A dressing tool as defined in claim 8 wherein said opposed means on said front portion comprises respective set screws in said body for respectively engaging said intermediate body section.

10. A diamond point mount as defined in claim 8 including:

said spaced slices extending to a predetermined point towards said rear portion to define said intermediate body section as a shank member integral with said diamond point support member, and said opposed means on said front portion being engageable with respective opposite sides of said shank member.

11. A diamond point mount as defined in claim 10 including:

said slices being in parallel relationship when defining said shank member and then at a predetermined point extending respectively in lateral opposite directions through said body to define said diamond support member integral with said shank member, and said opposed means near said front portion comprising respective opposed set screws in said body for respectively engaging said shank member from opposite sides.

12. A dressing tool for grinding wheels, comprising:

a base having a forward end and a rear end, a template with a predetermined profile mounted on said rear end, a vertically disposed first plate having a front and rear side and fixedly secured to said forward end, a second plate disposed in juxtaposition with the front side of said first plate, said first and second plate being provided with respective openings capable of being in registration, the opening in said first plate defining a first ball socket and the opening in said second plate defining a second ball socket, a first and second respective ball in said first and second respective ball sockets, an elongated tracing rod having a first end and a second end, said first end slidably journalled through said first ball into said second ball and anchored thereto, an adjustable stop on said rod intermediate said rear end of said base and said first ball, yielding means on said rod intermediate and engaging said stop and said first ball whereby said second plate is yieldingly held in juxtaposition with said first plate and capable of movement relative thereto corresponding to movement of said rod, said yielding means also serving to secure said first ball against lateral and vertical movement relative to said first plate but retaining the capability of said first ball to turn in place, a diamond point mount means operatively secured to said second plate and correspondingly movable therewith, said second end of said rod disposed and adapted for manual movement in contact with said profile whereby said first end acts against said second ball to effect movement of said second plate and said diamond point mount means to reproduce the template profile, and the respective distances between parallel vertical lines and between parallel horizontal lines extending respectively through the axes of said first and second balls remaining constant by slidable movement of said rod through said first ball as said second ball is moved laterally, vertically and diagonally in response to movement of said rod.

13. A dressing tool as defined in claim 12 including the means for anchoring said first end of said rod to said second ball comprising a pin disposed transversely through said second ball and said first end.

14. A dressing tool as defined in claim 12 including said yielding means being a coil spring.

15. A dressing tool as defined in claim 12 including means for securing said second ball to said second plate whereby rotation of said rod effects rotation of said second plate and correspondingly effects rotation of said diamond point mount means.

16. A dressing tool as defined in claim 12 including:

said second ball being provided with a through bore for receiving said first end of said rod and also provided with a transverse opening intersecting said bore, said first end of said rod provided with an opening adapted to register with said transverse opening, said opening in said second plate provided with oppositely disposed slots in registration with said transverse opening, and a pin disposed through said transverse opening in said second ball and the opening in said first end of said rod and extending from opposite sides of said second ball into said respective slots whereby said rod is anchored to said second ball and said second ball is operatively secured to said second plate and capable of acting on said second plate to produce any direction of movement thereof including rotation in response to corresponding movement of said rod.

17. A dressing tool as defined in claim 12 wherein said diamond point mount means comprises:

an elongated body having a front portion which includes a diamond point support member and a rear portion, means on said rear portion for removable attachment to said second plate, said front portion provided with spaced slices therethrough embracing said diamond point support member to define an intermediate body section free of engagement with said body but capable of movement within the confines of said slices, means for mounting a diamond point on said diamond point support member, and opposed means on said front portion for respectively engaging said intermediate body section from opposite sides to selectively move it within the confines of said slices for adjusting said diamond point to dead center.

18. A dressing tool as defined in claim 17 wherein said opposed means on said front portion comprises respective set screws in said body for respectively engaging said intermediate body section.

19. A dressing tool as defined in claim 12 wherein said diamond point mount means comprises:

an elongated body having a front end which includes a diamond point support portion and a rear end, means on said rear end for removable attachment to said second plate, said body provided with spaced slices therethrough embracing said diamond point support portion and extending to a predetermined point towards said rear end to define a shank member integral with said diamond support portion whereby said dimaond point support portion and said shank member are free of engagement with said body but capable of movement within the confines of said slices, means for mounting a diamond point on said diamond point support portion, and opposed means near said front end for respectively engaging said shank member from opposite sides to selectively move it within the confines of said slices for adjusting said diamond point to dead center.

* * * * *